US008794601B2

(12) United States Patent
Dempsey et al.

(10) Patent No.: US 8,794,601 B2
(45) Date of Patent: Aug. 5, 2014

(54) HUMIDIFIER

(75) Inventors: Daniel J. Dempsey, Carmel, IN (US); Michael L. Brown, Greenwood, IN (US)

(73) Assignee: Carrier Corporation, Farmington, CT (US)

( * ) Notice: Subject to any disclaimer, the term of this patent is extended or adjusted under 35 U.S.C. 154(b) by 334 days.

(21) Appl. No.: 13/328,345

(22) Filed: Dec. 16, 2011

(65) Prior Publication Data

US 2012/0152513 A1 Jun. 21, 2012

Related U.S. Application Data

(60) Provisional application No. 61/423,782, filed on Dec. 16, 2010.

(51) Int. Cl.
*B01F 3/04* (2006.01)

(52) U.S. Cl.
USPC ..... 261/30; 261/102

(58) Field of Classification Search
USPC ..... 261/26, 30, 102; 55/315; 165/222
See application file for complete search history.

(56) References Cited

U.S. PATENT DOCUMENTS

| | | | | |
|---|---|---|---|---|
| 4,754,806 | A | 7/1988 | Astle, Jr. | |
| 4,891,004 | A | 1/1990 | Ballard et al. | |
| 5,109,916 | A | 5/1992 | Thompson | |
| 5,184,600 | A | 2/1993 | Astle, Jr. | |
| 5,348,691 | A | 9/1994 | McElroy et al. | |
| 5,562,089 | A | 10/1996 | Astle, Jr | |
| 5,620,302 | A | 4/1997 | Garrison et al. | |
| 6,021,775 | A | 2/2000 | Dempsey et al. | |
| 6,595,201 | B2 | 7/2003 | Garloch et al. | |
| 6,708,517 | B1 * | 3/2004 | Piao et al. | 62/324.1 |
| 6,793,015 | B1 | 9/2004 | Brown et al. | |
| 6,851,948 | B2 | 2/2005 | Dempsey et al. | |
| 7,066,396 | B2 | 6/2006 | Knight et al. | |
| 7,695,273 | B2 | 4/2010 | Dempsey | |
| 2009/0001179 | A1 | 1/2009 | Dempsey | |

FOREIGN PATENT DOCUMENTS

| | | | |
|---|---|---|---|
| WO | 2008054382 | A1 | 5/2008 |

OTHER PUBLICATIONS

Dustin Caldwell et al., "Low-Cost Manufacturable Microchannel Systems for Passive PEM Water Management", Pacific Northwest National Laboratories, Jun. 12, 2008, pp. 1-18, Richland, WA.

* cited by examiner

*Primary Examiner* — Robert A Hopkins
(74) *Attorney, Agent, or Firm* — Cantor Colburn LLP

(57) ABSTRACT

A humidifier is provided and includes a membrane, which is permeable to water of a condensate supply but impermeable to acid of the condensate supply and a housing system to urge airflow across the membrane to humidify air with the water of the condensate supply.

20 Claims, 2 Drawing Sheets

HUMIDIFIER

CROSS REFERENCE TO RELATED APPLICATION

This non-provisional application is related to and claims the benefit of priority of U.S. Provisional No. 61/423,782 filed Dec. 16, 2010 and entitled "HUMIDIFIER," the entire contents of which are incorporated herein by reference.

BACKGROUND OF THE INVENTION

The subject matter disclosed herein relates to a humidifier and a system for controlling humidity in an enclosed space.

Current humidifier technology delivers humidified air to a conditioned space. This is typically achieved by providing a supply of water to the humidifier and driving an airflow that is humidified by various processes using the water supply. Often, the water is supplied from a potable water line having a valve that controls water flow in response to humidistat demand.

Recently, however, water supplies have begun to dwindle in parts of the world and the price of water worldwide has begun to increase. As a result, recycling of water is often desirable in terms of environmental protection and economic concerns. As such, it has been observed that use of potable water for humidifiers represents a high demand of an expensive resource.

BRIEF DESCRIPTION OF THE INVENTION

According to one aspect of the invention, a humidifier is provided and includes a membrane, which is permeable to water of a condensate supply but impermeable to acid of the condensate supply and a housing system to urge airflow across the membrane to humidify air with the water of the condensate supply.

According to another aspect of the invention, a humidifier is provided and includes a membrane, which is permeable to water of a condensate supply but impermeable to acid of the condensate supply and a housing system to urge airflow across the membrane to humidify air with the water of the condensate supply by diffusion.

According to yet another aspect of the invention, a system for controlling humidity in an enclosed space is provided and includes a furnace to generate heat and having a surface on which furnace condensate collects and a humidifier, which is receptive of the furnace condensate, including a membrane, which is permeable to water of a condensate supply but impermeable to acid of the condensate supply and a housing system to urge airflow across the membrane to humidify air with the water of the condensate supply by diffusion.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
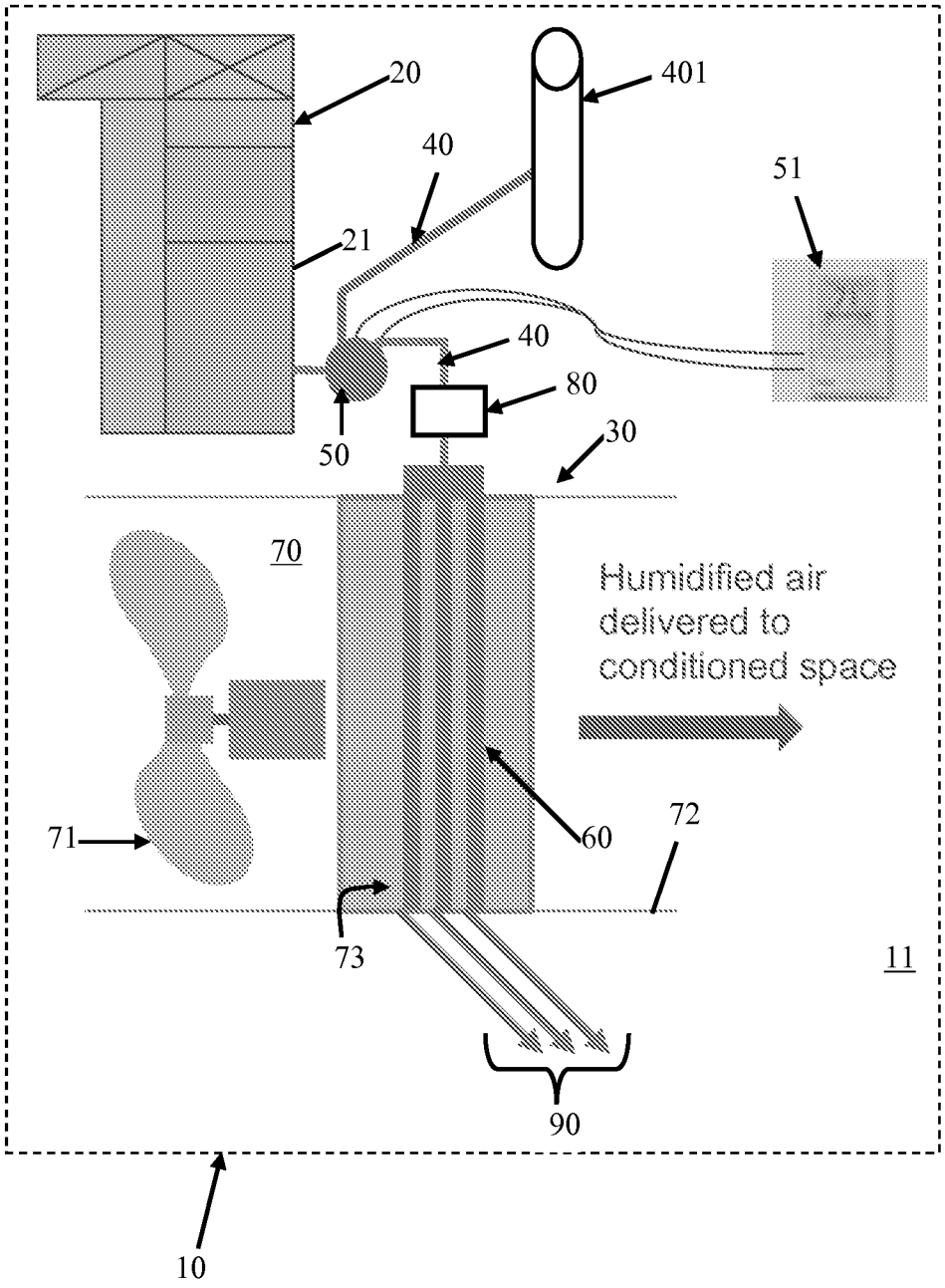
FIG. 1 is a schematic illustration of a system for controlling humidity.
Figure 2:
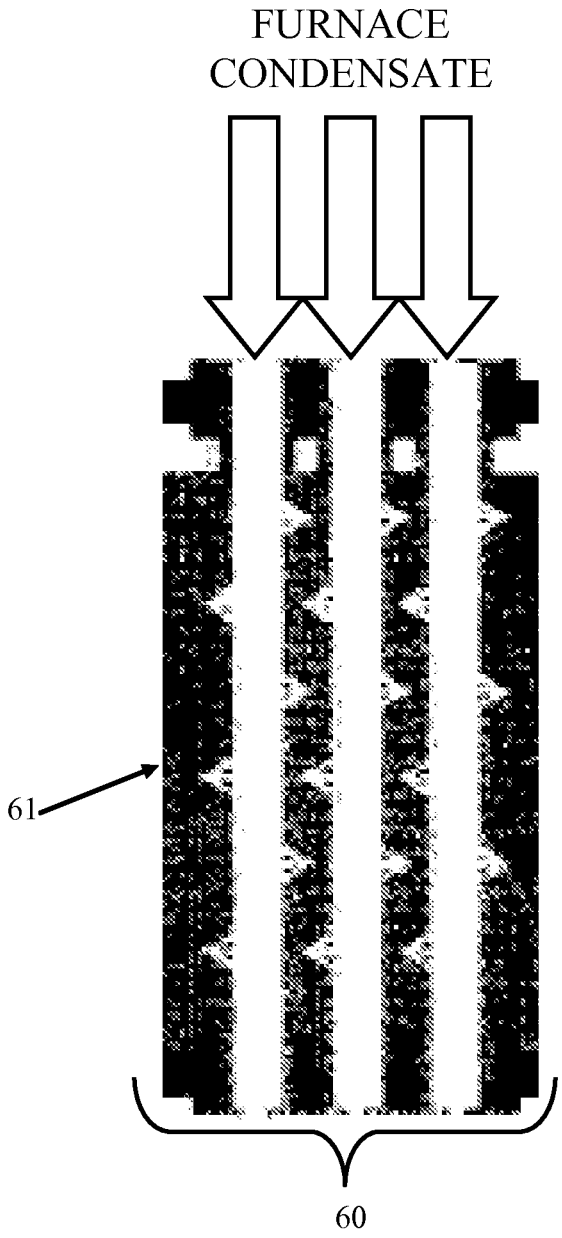
FIG. 2 is a schematic illustration of a member for use in the system of FIG. 1.

With reference to FIGS. 1 and 2, a system 10 for controlling humidity in an enclosed space 11 is provided. The system 10 includes a heat source 20, such as a condensing furnace, to generate heat and a humidifier 30. The heat source 20 has a surface 21 on which a supply of condensate, such as furnace condensate, collects in accordance with the heat generated from the latent heat of vaporization by condensing the moisture in the products of combustion. The humidifier 30 is receptive of the condensate supply by way of piping 40 and a pump 50 disposed along the piping 40. The humidifier 30 includes a membrane 60, which is permeable to water of the condensate supply but impermeable to acid of the condensate supply, and a housing system 70. The housing system 70 urges airflow across the membrane 60 to humidify air carried along the airflow with the water of the condensate supply by various processes, such as diffusion.

The piping 40 extends between the heat source 20 and the humidifier 30 such that the piping 40 collects the condensate supply and is configured to transfer the condensate supply to the humidifier 30. In particular, the piping 40 may be coupled directly to the membrane 60 so that condensate supply can be transferred directly to the membrane 60. The pump 50 is operably disposed on or along the piping 40 and is configured to modulate transfer of the condensate supply from the heat source 20 to the humidifier 30. A humidity of the space 11 is thereby controllable in accordance with an operation of the pump 50 in that the pump 50 can increase or decrease an amount of water provided for humidifying the air. The pump 50 may also be coupled to a humidistat 51 and may be further controlled in accordance with humidistat demand.

In an alternate embodiment, the piping 40 may also be coupled to a potable water supply, such as a potable water line 401, such that additional water can be transferred to the humidifier 30 in case condensate supply is insufficient to meet humidistat demand. In these cases, the pump 50 may be operably disposed on the piping 40 to further modulate the transfer of potable water to the humidifier 30.

In accordance with embodiments and, as shown in FIG. 2, the membrane 60 may include a water-to-air membrane with a nano-porous structure 61 that is formed to support a base. As such, as condensate supply comes into contact with the membrane 60 water is permitted to be absorbed into and/or to flow through the membrane 60 but acid flow is blocked and, in some cases, the acids are neutralized. That is, the acids, which may include acids such as hydrochloric acid or sulfuric acid, and which are carried along with the condensate supply, are blocked and prevented from being absorbed into and/or flowing through the membrane 60 by the membrane 60 and, in addition, the acids may react with the base and form salt compounds that are removable from the water of the condensate supply. As a result, as air passes across the membrane 60 and is humidified by, for example, diffusion, no direct contact between the air and the acids occurs. The acids are, thus, substantially prevented from being incorporated into the air that is output from the humidifier 30 and into the enclosed space 11.

The base may include, for example, sodium hydroxide, ammonium hydroxide or other similar compounds. The nano-porous structure 61 may be formed of ceramics or other similar materials that are non-reactive with the acids. During use, the membrane 60 may eventually become clogged with the salts formed by the processes described above or the base will be used up. In these cases, the membrane 60 can be removed, replaced or cleaned.

In accordance with further embodiments, the system 10 may be further configured such that the acids are blocked on a condensate side of the membrane 60 and a small flow of unabsorbed water of the condensate supply, now possessing an increased concentration of acid, is allowed to drain normally along drainage piping 90 to carry away the acid.

The housing system 70 may include a fan 71 or blower that is disposed proximate to the membrane 60 and a housing 72. The housing 72 houses the membrane 60 and provides structural support to the fan 71. The housing 72 may itself include an overflow reservoir 73 for storing additional condensate supply or water. The housing is sufficiently large to substantially enclose the membrane 60 and, for a home or a leaky space, the size of the membrane 60 and the housing 72 may be increased from a size that would normally be used for a similar sized space. That is, for an enclosed space with a relatively high air infiltration rate, the respective sizes of the membrane 60 and the housing 72 may be larger than they otherwise would be. Conversely, for an enclosed space with a relatively low air infiltration rate, the size of the membrane 60 and the housing 72 may be smaller.

In accordance with further embodiments, a condensate filter/acid neutralizer 80 may be provided along the piping 40 upstream from the humidifier 60. This filter 80 would remove particulate contaminants in the water along with some other acids/contaminants that might not be stripped by the membrane 60.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A humidifier, comprising:

a membrane, which is permeable to water of a condensate supply but impermeable to acid of the condensate supply; and a housing system to urge airflow across the membrane to humidify air with the water of the condensate supply.

2. The humidifier according to claim 1, wherein the membrane comprises a water-to-air membrane.

3. The humidifier according to claim 1, wherein the membrane comprises a nano-porous structure.

4. The humidifier according to claim 1, wherein the membrane comprises a base to react with the acid.

5. The humidifier according to claim 1, wherein the housing system comprises a fan disposed proximate to the membrane.

6. The humidifier according to claim 1, wherein the housing system comprises:

a housing to house the membrane; and an overflow reservoir.

7. The humidifier according to claim 1, further comprising a filter to remove particulate contaminants and/or acids from the condensate supply.

8. A humidifier, comprising:

a water-to-air, nano-porous membrane, which is permeable to water of a condensate supply but impermeable to acid of the condensate supply; and a housing system to urge airflow across the water-to-air, nano-porous membrane to humidify air with the water of the condensate supply by diffusion.

9. A system for controlling humidity in an enclosed space, comprising:

a furnace to generate heat and having a surface on which furnace condensate collects; and a humidifier, which is receptive of the furnace condensate, including a membrane, which is permeable to water of a condensate supply but impermeable to acid of the condensate supply and a housing system to urge airflow across the membrane to humidify air with the water of the condensate supply by diffusion.

10. The system according to claim 9, further comprising:

piping extending between the furnace and the humidifier; and a pump operably disposed on the piping to modulate transfer of the furnace condensate from the furnace to the humidifier.

11. The system according to claim 10, wherein a humidity of the space is controllable in accordance with an operation of the pump.

12. The system according to claim 10, wherein the piping is coupled to the membrane.

13. The system according to claim 10, wherein the piping is coupled to a potable water supply, the pump being operably disposed on the piping to further modulate transfer of potable water to the humidifier.

14. The system according to claim 9, wherein the membrane comprises a water-to-air membrane.

15. The system according to claim 9, wherein the membrane comprises a nano-porous structure.

16. The system according to claim 9, wherein the membrane blocks passage of the acid and comprises a base to react with the acid to form a salt, which is removable from the water.

17. The system according to claim 9, wherein the housing system comprises:

a fan disposed proximate to the membrane; and a housing to house the membrane and on which the fan is supported.

18. The system according to claim 9, wherein the housing system comprises an overflow reservoir.

19. The system according to claim 9, further comprising a filter upstream from the membrane to remove particulate contaminants and/or acids from the furnace condensate.

20. The system according to claim 9, further comprising drainage piping along which unabsorbed water of the condensate supply drains to carry away the acid of the condensate supply.

* * * * *